US005694786A

United States Patent [19]

Huang

[11] Patent Number: 5,694,786

[45] Date of Patent: Dec. 9, 1997

[54] RETRIEVING SYSTEM FOR CONDENSED WATER OF AIR CONDITIONING SYSTEM

[76] Inventor: San-Shuo Huang, 12, Alley 4, Lane Jen Ai, Yuan Tun Road, Sec 2, Yuan Lin Town, Changhua, Taiwan

[21] Appl. No.: 566,106

[22] Filed: Dec. 1, 1995

[51] Int. Cl.[6] ..... F25D 21/14; F25B 47/00

[52] U.S. Cl. ..... 62/285; 62/279

[58] Field of Search ..... 62/272, 279, 285, 62/288, 289

[56] References Cited

U.S. PATENT DOCUMENTS

| | | | |
|---|---|---|---|
| 3,758,236 | 9/1973 | Zimmerman | 62/285 |
| 4,462,460 | 7/1984 | Braver | 165/26 |
| 4,998,412 | 3/1991 | Bell | 62/126 |
| 5,327,743 | 7/1994 | Coltrin | 62/279 |

*Primary Examiner*—William Doerrler
*Attorney, Agent, or Firm*—Beveridge, DeGrandi, Weilacher & Young LLP

[57] ABSTRACT

A retrieving system for condensed water of air conditioning system, which will collect condensed water produced air conditioning system operation for utilization; which will collect condensed water produced during operation of air conditioning system via condensed water pipe into reservoir, and filtering net will filter out dirt when condensed water flowing into reservoir, when water level inside reservoir reaches preset level, float ball switch will turn on pump outside of the reservoir automatically, which will pump cool condensed water from reservoir into cooling tower, when water level of reservoir lowered to lower limit, float ball switch will turn off pump automatically, in this way we can get cyclic turn-on and turn-off operation to save electricity and water of air conditioning system simultaneously.

3 Claims, 1 Drawing Sheet

RETRIEVING SYSTEM FOR CONDENSED WATER OF AIR CONDITIONING SYSTEM

BACKGROUND AND SUMMARY OF THE INVENTION

The present invention is a retrieving system for condensed water of an air conditioning system which will collect condensed water produced, by operation of an air conditioning system, into a reservoir. Then, by utilizing a float ball as a device for controlling the water level, the condensed water is pumped into a cooling tower. Using such a cyclic reserve water and pump water operation can save water and electricity.

As living conditions improve and industry develops, the use of air conditioning systems for both home and work has become more and more popular. There are two major kinds of air condition systems, one is an air cooling type and the other is a water cooling type. Water can carry much more heat than air in the same volume, so open circulation water cooling systems are the most popular, and specifically, water cooling air condition systems using a cooling tower to supply cooled water into the heat exchanger of an air conditioning system to lower the temperature of air blowing into the space we want. In the past, the cooling water used inside the cooling tower was underground water or water piped directly without any purifying and softening processes. After a period of usage, the water becomes hardened, which causes scale growth on the walls inside of the pipes of the heat exchanger and the cooling tube. This will cause:

A. blocking the flow of the cooling water;
B. deteriorated heat exchange ability;
C. increased electricity consumption;
D. reduced cooling effect; and
E. and in the worst case, it will cause the air conditioner to shut down.

Clearing the scale away from the wall of the tube by applying erosive chemicals into the circulating water of the cooling tower, which will take the scale away, results in the tube wall becoming corroded, and the polluted water produced thereby will cause another environmental problem.

Also, when the air conditioning system is under operation, it produces condensed water, when air goes through the heat exchanger tube. This condensed water is collected into a collection tray located under the blowing fan of the air conditioning system, and then is usually drained outdoors. This also results in a waste of water resource.

As understood from the above description, the existing open circulation air conditioning systems have many deficiencies, such as the condensed water resource being wasted. This stimulates the idea to create a system to collect condensed water, and use this condensed water to increase the efficiency of an air conditioning system. After many trials and experiments, this preferred embodiment was invented.

SUMMARY OF THE INVENTION

The present invention is a retrieving system for condensed water of an air conditioning system which utilizes condensed water produced during operation of the air conditioning system to save both water and electricity.

BRIEF DESCRIPTION OF THE DRAWINGS

The present invention will now be described by way of example with reference to the annexed drawing, in which.

DETAILED DESCRIPTION OF THE PREFERRED EMBODIMENT

Figure 1:
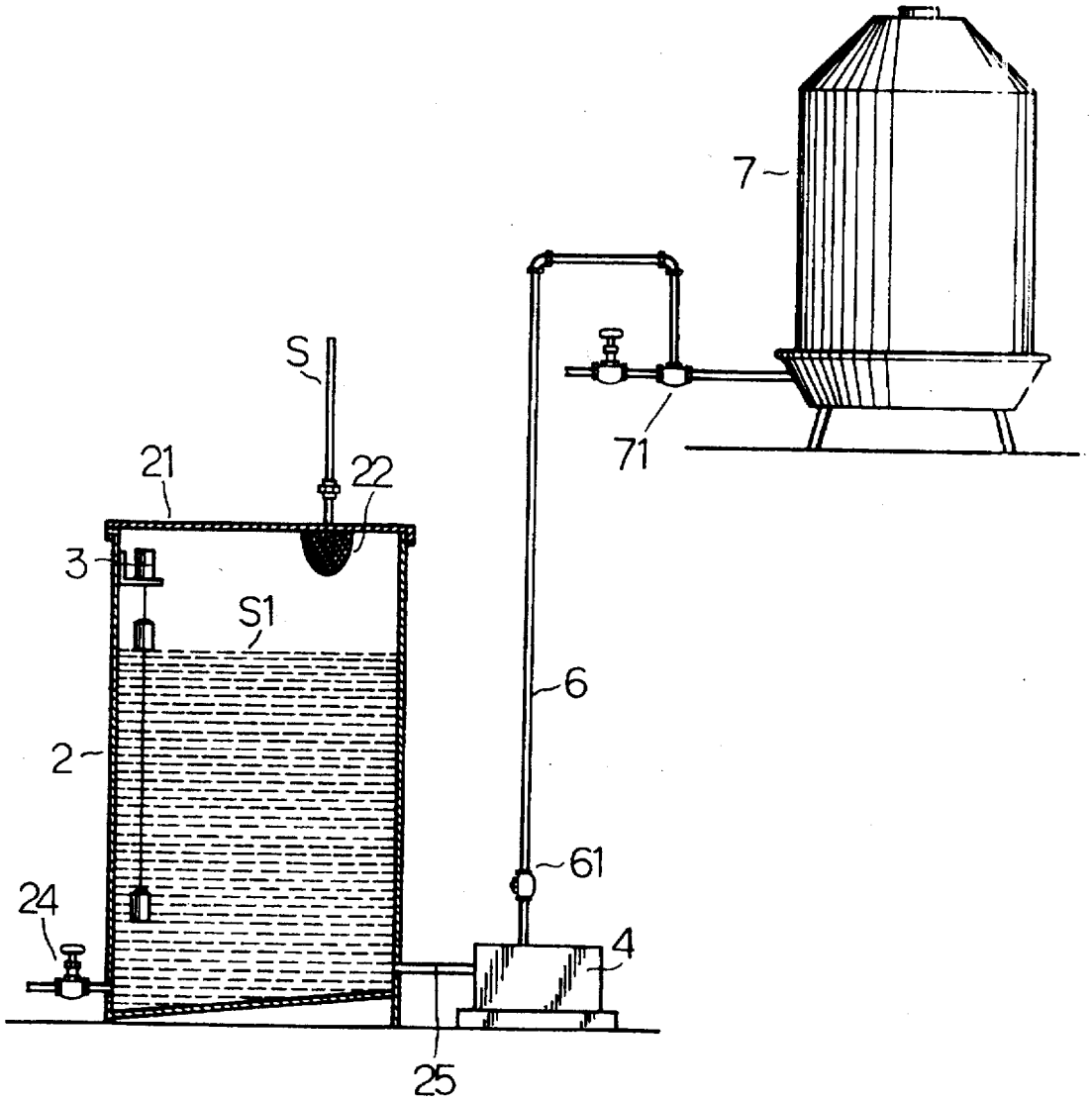
FIG. 1 is a schematic drawing of present invention.

Referring to FIG. 1, the present invention is a retrieving system for condensed water of an air conditioning system which retrieves the condensed water produced during operation of the air conditioning system. The system includes a reservoir 2, installed in the base floor of a building. A cover 21, having a pipe head S connected with condensed water tube and a filtering net 22 at the lower end of pipe head S, covers reservoir 2. On one side of the bottom of reservoir 2 is a drain port 23, which is controlled by control valve 24. On the other end of the reservoir 2 is pumping port 25 which connects with pump 4. A float ball switch 3, which is installed at a suitable position inside the reservoir 2, controls the water level automatically. Pump 4 has one end connected with pumping port 25 of reservoir 2 and the other end connected with output pipe 6. Output pipe 6 is connected with pump 4 through check valve 61, which is installed at a suitable position. The other end of output pipe 6 connects with supplement valve pipe 71 of cooling tower 7.

When the above mentioned components are assembled together into the preferred embodiment, condensed water Sl produced by an air conditioning system is collected via condensed water tube S into reservoir 2 and filtering net 22 filters out dirt at the end of condensed water tube S. When water level inside reservoir 2 reaches a predetermined level, float ball switch 3 turns on pump 4 outside of the reservoir 2 automatically, which pumps condensed water Sl from reservoir 2 into cooling tower 7. When the water level of reservoir 2 lower to a predetermined lower limit, float ball switch 3 will turn off pump 4 automatically. In this way, a cycling turn-on and turn-off operation is achieved. Since the condensed water Sl is produced when air flows through cooling pipes and the moisture in the air condenses out, this condensed water Sl has a very low mineral content. Use of this water prevents scale from forming inside the tube walls of the cooling pipe of the heat exchanger pipe and thus, saves a lot of loss caused by scale formed inside the tube walls. As a result, the air conditioning system will experience increased cooling capacity, reduced electrical requirements, better heat exchange effects and avoid negative environmental impact caused by using de-scaling chemicals. Also, the condensed water Sl can not only supplement the cooling water, but also can be used to replace the water inside cooling tower 7, resulting in increased heat exchange effects, increased cooling capacity, conservation of water and electricity savings.

The present invention has another specialty, which is that when the water level of the cooling tower 7 exceeds the brim opening, the water spills out automatically and the forced pumping of new condensed water into cooling tower 7 still operates without supplement requirement. When cooling tower 7 is under long time operation, the mineral contents inside the water grow quickly, also the dust and insects present in the air may fall into the cooling water which further deteriorates the integrity of the water. Algae and viruses grow inside the polluted water, which not only cause disease inside the air conditioned building but also, forms scales inside the condensor tube wall, which reduces the cooling capacity and the life of the air conditioning system. Therefore, when condensed water collected inside the reservoir can have more volume than water been consumed by the cooling tower, then the extra condensed water can be pumped into the cooling tower forcibly, and in this way, the water level of the cooling tower increases quickly and eventually spills out. The water inside the cooling tower can thus be renewed and cleaned in a cyclic way, and the pollution of the cooling water reduced. Thus, the more condensed water collected which can be used to replace old water inside the cooling tower can clean the cooling tower and thereby reduce cooling tower cleansing problems. Therefore, the present invention collects condensed water to save energy, save water and reduce environmental problem in one step.

Thus, the present invention yields great benefits on water conservation, electricity savings and increases the effect of the air conditioning system.

What is claimed is:

1. A retrieving system for condensed water of an air conditioning system, comprising:

a storage reservoir having a large storage water capacity and a storage reservoir cover;

a pipe head for connecting with a condensed water pipe;

a filtering net on the lower end of said pipe head;

a drain port at the bottom of said storage reservoir;

a valve for controlling said drain port;

a pumping pipe head at the bottom of said storage reservoir;

a float ball switch installed inside said storage reservoir for controlling the water level in said storage reservoir;

a pump reservoir;

a pump having one end connected with said pumping pipe head of said storage reservoir and housed in said pump reservoir, said pump reservoir having a substantially smaller water holding capacity than said large storage water capacity of said storage reservoir;

an output pipe connected at one end to said pump; and a cooling tower connected to said output pipe, wherein, when an upper water level inside said storage reservoir reaches an upper limit, said float ball switch turns on said pump, said pump transferring condensed water from said storage reservoir through said pump reservoir and into said cooling tower, and when a lower water level inside said storage reservoir reaches a lower limit, float ball switch turns off said pump.

2. A retrieving system for condensed water of an air conditioning system as defined in claim 1, wherein:

a water holding capacity of said storage reservoir is substantially larger than a water holding capacity of said cooling tower.

3. A retrieving system for condensed water of an air conditioning system as defined in claim 1, wherein;

said upper water level is a greater volume of water than a water holding capacity of said cooling tower.

* * * * *